US009296963B2

(12) United States Patent
Berg

(10) Patent No.: US 9,296,963 B2
(45) Date of Patent: Mar. 29, 2016

(54) ARRANGEMENT FOR AND METHOD OF GASIFYING SOLID FUEL

(75) Inventor: Eero Berg, Varkaus (FI)

(73) Assignee: AMEC FOSTER WHEELER ENERGIA OY, Espoo (FI)

( * ) Notice: Subject to any disclaimer, the term of this patent is extended or adjusted under 35 U.S.C. 154(b) by 307 days.

(21) Appl. No.: 13/990,437

(22) PCT Filed: Dec. 19, 2011

(86) PCT No.: PCT/FI2011/051135

§ 371 (c)(1),
(2), (4) Date: Jun. 25, 2013

(87) PCT Pub. No.: WO2012/085345

PCT Pub. Date: Jun. 28, 2012

(65) Prior Publication Data

US 2013/0263509 A1 Oct. 10, 2013

(30) Foreign Application Priority Data

Dec. 20, 2010 (FI) ..... 20106344

(51) Int. Cl.
*C10J 3/72* (2006.01)
*C10J 3/56* (2006.01)
(Continued)

(52) U.S. Cl.
CPC .... *C10J 3/72* (2013.01); *C10J 3/56* (2013.01); *C10J 3/84* (2013.01); *C10J 3/86* (2013.01);
(Continued)

(58) Field of Classification Search
CPC combination set(s) only.
See application file for complete search history.

(56) References Cited

U.S. PATENT DOCUMENTS 3,868,817 A * 3/1975 Marion ..... C01B 3/36 252/373
4,436,530 A * 3/1984 Child ..... C10J 3/466 252/373

(Continued)

FOREIGN PATENT DOCUMENTS

DE 19754802 A1 6/1999
EP 1580253 A1 9/2005

(Continued)

OTHER PUBLICATIONS

Notice Concerning Transmittal of and International Preliminary Report on Patentability completed Jun. 25, 2013, and mailed Jul. 4, 2013, in corresponding International Application No. PCT/FI2011/051135.

(Continued)

*Primary Examiner* — Kaity Handal
(74) *Attorney, Agent, or Firm* — Fitzpatrick, Cella, Harper & Scinto

(57) ABSTRACT

An arrangement for gasifying solid fuel includes a gasification reactor for producing further oxidizable product gas from solid fuel and a gas treatment reactor arranged in a flow direction of the product gas in gas flow connection with the gasification reactor. The gas treatment reactor includes a supply for supplying oxygenous gas to the gas treatment reactor for partial oxidization of product gas and for thermal cracking thereof. A radiation heat exchange cooler for cooling the product gas is arranged in connection with the gas treatment reactor to solidify melt components in the product gas. A discharge connection is arranged in the lower portion of the radiation heat exchange cooler for removing solidified melt components from the radiation heat exchange cooler. A method of gasifying solid fuel in a gasification reactor is also presented.

13 Claims, 2 Drawing Sheets

(51) Int. Cl.

| | |
|---|---|
| ***C10J 3/84*** | (2006.01) |
| ***C10J 3/86*** | (2006.01) |
| ***C10K 1/04*** | (2006.01) |
| ***C10K 3/00*** | (2006.01) |
| ***F23G 5/027*** | (2006.01) |
| ***F23G 5/30*** | (2006.01) |
| ***F28D 13/00*** | (2006.01) |
| *F28D 21/00* | (2006.01) |

(52) U.S. Cl.

CPC ..... *C10K 1/046* (2013.01); *C10K 3/005* (2013.01); *F23G 5/0276* (2013.01); *F23G 5/30* (2013.01); *F28D 13/00* (2013.01); *C10J 2300/0916* (2013.01); *C10J 2300/1884* (2013.01); *F23G 2201/301* (2013.01); *F23G 2201/40* (2013.01); *F23G 2203/501* (2013.01); *F28D 2021/0075* (2013.01)

(56) References Cited

U.S. PATENT DOCUMENTS

| | | | | |
|---|---|---|---|---|
| 4,602,573 | A * | 7/1986 | Tanca | C10J 3/485 110/229 |
| 4,676,177 | A * | 6/1987 | Engstrom | C10J 3/54 110/210 |
| 4,783,197 | A * | 11/1988 | Mathiesen et al. | 44/280 |
| 4,912,931 | A * | 4/1990 | Joshi et al. | 60/732 |
| 5,922,090 | A * | 7/1999 | Fujimura et al. | 48/197 R |
| 6,286,443 | B1 * | 9/2001 | Fujinami | F23G 5/027 110/208 |
| 6,455,011 | B1 * | 9/2002 | Fujimura | C10J 3/54 422/139 |
| 6,709,636 | B1 * | 3/2004 | Oshita | C10J 3/482 422/139 |
| 7,587,995 | B2 | 9/2009 | Kraft et al. | |
| 7,744,665 | B2 * | 6/2010 | Holle | C10J 3/466 48/197 R |
| 7,896,956 | B2 * | 3/2011 | Takase | B01D 46/006 110/345 |
| 8,084,656 | B2 | 12/2011 | Feldmann | |
| 8,118,890 | B2 * | 2/2012 | Schingnitz | C10J 3/466 423/644 |
| 2005/0247553 | A1 | 11/2005 | Ichikawa et al. | |
| 2007/0119577 | A1 | 5/2007 | Kraft et al. | |
| 2007/0175095 | A1 | 8/2007 | Ito et al. | |
| 2008/0216405 | A1 | 9/2008 | Ichikawa et al. | |
| 2009/0090053 | A1 | 4/2009 | Feldmann | |

FOREIGN PATENT DOCUMENTS

| | | | |
|---|---|---|---|
| EP | 1724326 | A1 | 11/2006 |
| JP | 11043681 | A1 | 2/1999 |
| JP | 2006-002042 | A | 1/2006 |
| WO | 2009/064584 | A1 | 5/2009 |
| WO | 2010/069068 | A1 | 6/2010 |

OTHER PUBLICATIONS

Communication with Supplementary European Search Report completed Feb. 13, 2015, and mailed Feb. 24, 2015, in counterpart European Patent Application No. 11852088.1-1361/2655568.

Notification of and International Search Report completed Apr. 16, 2012, and mailed on Apr. 24, 2012, in International Application No. PCT/FI2011/051135.

Written Opinion mailed on Apr. 24, 2012, in International Application No. PCT/FI2011/051135.

Finnish Office Action dated Sep. 19, 2011, issued in counterpart Finnish Patent Application No. 20106344.

* cited by examiner

ARRANGEMENT FOR AND METHOD OF GASIFYING SOLID FUEL

This application is a U.S. national stage application of PCT International Application No. PCT/FI2011/051135, filed Dec. 19, 2011, published as International Publication No. WO 2012/085345 A1, and which claims priority from Finnish patent application number 20106344, filed Dec. 20, 2010.

FIELD OF THE INVENTION

The present invention relates to an arrangement for gasifying solid fuel.

The invention also relates to a method of gasifying solid fuel.

BACKGROUND OF THE INVENTION

Hot gases treated in certain industrial processes contain components that have a tendency to stick on, for example, heat exchange surfaces. Sticky compounds may also be generated as a result of cooling. This complicates the recovery of heat from the gases or cooling the gas.

Problems also appear in the gasification processes because of the substances mat stick on heat exchange surfaces. Gasification or combustion of solid carbonaceous material in a circulating fluidized bed reactor, in which such a high gas flow velocity is maintained that a considerable portion of the solid particles is entrained with gas from the reaction chamber and after particle separation mainly returned to the fluidized bed, has been noted to have many advantages as compared to conventional gasification or combustion methods.

When gasifying carbonaceous fuels, such as biofuels or waste-derived fuels, generally, air and/or oxygen, as well as steam, are supplied, to the gasification reactor, whereby an object is to generate product gas, the main components of which are carbon monoxide CO, hydrogen $H_2$, and hydrocarbons $C_xH_y$. Ash particles and residual carbon are usually entrained with the product gas exiling from the gasification reactor. Depending on the concept, they must possibly be separated by a particle separator, for example, by a filter, prior to further use of the product gas. Generally, the aim is to optimize the efficiency of the gasification system in such a way that the coal conversion level of the fuel is as high as possible, in other words, the content of the residual carbon in the ash removed from the equipment is as low as possible.

Especially, with the gasification gases derived from biofuels, heat recovery and also, possibly, further use of the gas are substantially complicated by components that are contained in the biofuels and have a tendency to stick on, for example, the heat exchange surfaces. Sticky compounds may also be generated as a result of cooling.

The product gas exiting from the gasification reactor also generally contains ash particles, which need to be removed, for example, by means of a particle filter prior to further use of the product gas. Since the particle filters that filter the gas at a high temperature are expensive and are prone to being damaged, the product gas is generally cooled prior to the filtering. Especially, when gasifying waste materials and biomass, considerable amounts of tar compounds can be generated. Here, tar compounds refer to compounds or components that are gaseous at the gasification temperature, but are condensed at lower temperatures to droplets, which stick easily, and further, even to solid particles, which can build up, for example, on heal exchange surfaces of the gas cooler or cause filter deposits that are difficult to be removed. Thus, tar compounds, for example, reduce the heat exchange efficiency of the heat exchange surfaces, weakening the operation of the equipment and clogging the filtering elements of the filter, thereby, increasing die pressure loss.

The amount of tar compounds can be diminished by means of thermal cracking. The tar compounds are then decomposed by thermal cracking, and the amount of tar compounds in the final product gas diminishes. The thermal cracking of the product gas is performed by raising the gas temperature, after gasification, high enough, whereby, die generated tars are decomposed to simpler compounds. The simplest way to do this is to introduce either oxygen or air to the product gas. A portion of the combustible components of the gas thereby burns and the temperature rises. The temperature required for cracking of tar compounds is about 1000° C. to about 1200° C. The product gas consumed for combustion is compensated for by compounds generated in thermal cracking.

Japanese Patent Publication No. 11-043681 discloses gasification of biofuels in a fluidized bed reactor. The product gas from a fluidized bed reactor is guided to an oxidizing oven operating at a temperature higher than that of the fluidized bed reactor, in which oven, secondary gasification takes place. The temperature in the oxidizing oven is about 1200° C. to about 1600° C., whereby, for example, tar compounds decompose. The lower portion of the oxidizing oven is provided with a cooling portion, in which gas and the formed melt material are cooled by conducting them to water. The quick water cooling solidies the melt material, the thus granulated material is removed from the cooler, and the gas is guided to further treatment.

U.S. Patent Application Publication No. 2007/0175095 discloses a biomass gasification system, in which the product gas from the actual gasification stage is conducted to a downstream reforming unit, in which the tar components of the product gas are decomposed by thermal cracking. Oxygen is supplied to the reforming unit, whereby the fuel oxidizes, which increases the temperature to a level required by the thermal cracking. This causes cracking of tar compounds. Gas is cooled after die reforming unit and conducted to be used. Here, the melt material from the gasification stage is led to act as fuel in a separate heater that provides heat to the gasification. In the method disclosed in this publication, the question of the treatment of melt components generated in the actual thermal cracking remains completely open. Thus, the solution is especially prone to clogging of the heat surfaces downstream of the reforming unit.

SUMMARY OF THE INVENTION

It is an object of the invention to provide an arrangement for and a method of gasifying solid fuel, by means of which it is possible to minimize the problems of the prior art.

Objects of the invention are achieved by means of an arrangement for gasifying solid fuel which arrangement comprises a gasification reactor for producing oxidizable product gas from solid fuel and a gas treatment reactor arranged in a flow direction of the product gas in gas flow connection with the gasification reactor, the gas treatment reactor comprising a supply for supplying oxygenous gas to the gas treatment reactor for partial oxidation and thermal cracking of the product gas. The main characteristic feature of the invention is that a radiation heat, exchange cooler of the product gas is arranged in connection with the gas treatment reactor to solidify melt components in the product gas, and that a discharge connection is arranged in the lower portion of the radiation heat exchange cooler for removing solid material separated from the product gas, especially, solidified melt components, from the radiation heat exchange cooler.

By using such an arrangement no catalysts are needed for decomposing the tar components of the gasification gas, whereby the operation of the arrangement is reliable. At the same time, it is possible to cool down gas containing sticky and/or melt components produced in thermal cracking in a reliable manner, and to remove the components in a solid form. The arrangement is also energy efficient, as a considerable amount of heat is recovered from the sticky and/or melt components before their removal in solid form.

According to a preferred, embodiment of the invention, the radiation heat exchange cooler is formed of walls defining a gas space of the radiation heat exchange cooler. The walls of the radiation heat exchange cooler comprise heat exchange surfaces and the gas space remaining inside the walls is substantially free space.

In this manner, the risk of clogging of the cooler is minimized, and a reliable cooling and a change of sticky and/or melt components to non-sticky components is obtained prior to their removal from the cooler.

The gas treatment reactor is preferably a vertical reactor, the upper portion thereof being provided with an inlet for supplying the product gas to the reactor, and the lower portion thereof being provided with the radiation heat exchange cooler.

The lower portion of the radiation heat exchange cooler is preferably arranged with a turn chamber for the gas flow, the lower portion of which chamber is provided with the discharge connection and which chamber is provided with a gas discharge opening in such a manner that the flow direction of the gas flowing through the turn chamber substantially changes in the turn chamber. The gas discharge opening opens to the turn chamber preferably in such a manner that the gas flow direction changes in the turn chamber by at least ninety degrees.

Preferably, the upper portion of the gas treatment reactor comprises a refractory coating, for example, masonry.

According to a preferred embodiment, the gas discharge opening discussed above is connected to a convection boiler, comprising at least one heat exchanger. Preferably, the convection boiler comprises at least two heat exchangers, which are subsequently arranged in a horizontal direction. The heat exchanger or the heat exchangers of the convection boiler are preferably arranged directly above the bottom portion of the convection boiler and a conveyor for solid material is arranged at the bottom portion of the convection boiler. The conveyor is preferably arranged to transfer solid material from the bottom portion of the convection boiler to the lower portion of the turn chamber of the gas flow arranged in the lower portion of the radiation heat exchange cooler.

The gasification reactor is preferably a circulating fluidized bed reactor, which comprises a solids separator, the gas discharge connection of which is in gas flow connection with the gas treatment reactor.

The objectives of the invention are also achieved by a method of gasifying solid fuel in a gasification reactor, in which oxidizable product gas is produced from solid fuel, the product gas being led from the gasification reactor to a gas treatment reactor, to which gas treatment reactor oxygenous gas is introduced and product gas is partially oxidized, and its temperature is raised, whereby thermal cracking of the components of the product gas is achieved, it is a characteristic feature of the method that solid components of the product gas are melted and/or softened to become sticky, forming melt components, whereafter, the gas is directed to a radiation heat exchange cooler, in which the temperature of the product gas is decreased by means of radiation heat exchange in such a way that melt components in the product gas solidity and solidified components are discharged from the radiation heat exchange cooler in a solid form through a discharge connection arranged in the lower portion thereof.

The product gas is preferably guided to flow in the gas treatment reactor substantially vertically from the top downwards, and the direction of the product gas flow in the lower portion of the radiation heat exchange cooler is changed, whereafter, the product gas flow is conducted, to a convection boiler. The direction of the product gas flow is preferably changed by ninety to one hundred eighty degrees.

In the method, oxidizable product gas is produced from solid fuel in a fluidized bed, whereby the material composition of the fluidized bed is controlled, at least partially based on the melting or softening behavior of the gas components in the gas treatment reactor.

Other, additional characteristic features typical of the invention will become apparent in the accompanying claims and in the description of the embodiments shown in the figures.

BRIEF DESCRIPTION OF THE DRAWINGS

The invention and the operation thereof are described below with reference to the enclosed schematic drawings, in which FIG. 1 schematically illustrates an embodiment of an arrangement in accordance with the invention.

DETAILED DESCRIPTION OF THE PREFERRED EMBODIMENTS

Figure 1:
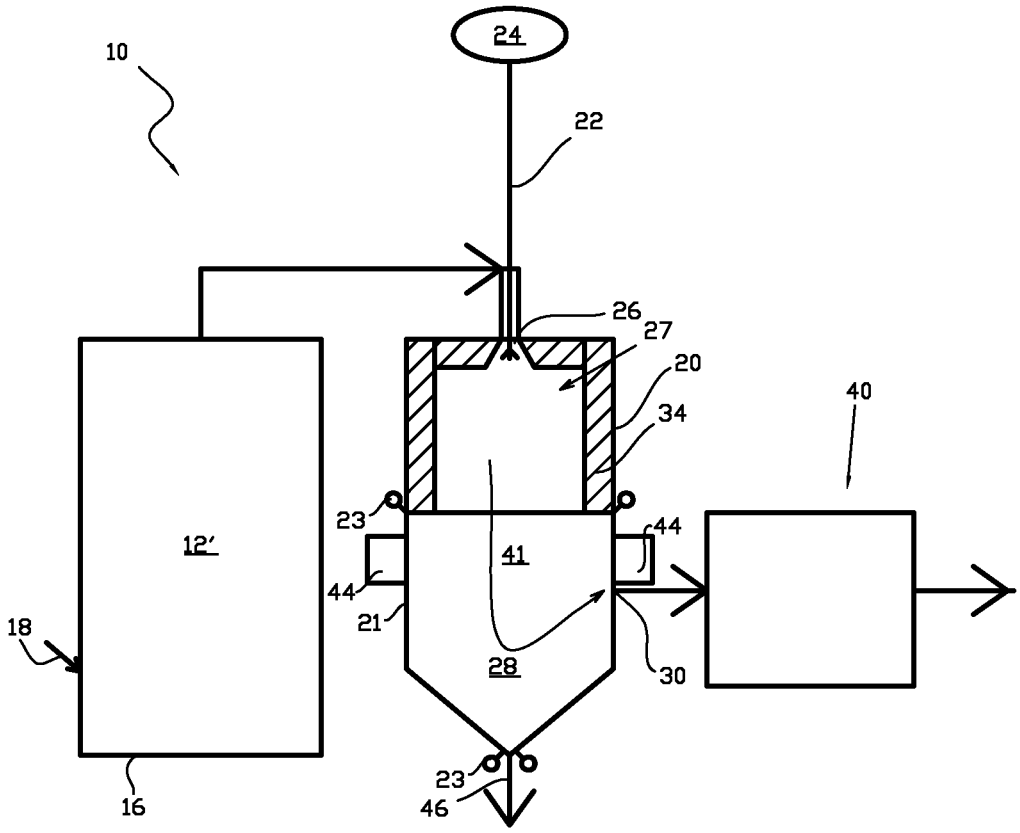

FIG. 1 shows an embodiment in accordance with die invention of an arrangement 10 for gasifying solid fuel. The embodiment of FIG. 1 comprises a gasification reactor 12', in which fuel is gasified in such a way that the product gas generated can be further oxidized. The arrangement also comprises a gas treatment reactor 20 arranged in a flow direction of the product gas, in gas flow connection with the gasification reactor 12' for thermal cracking of the product gas, and a radiation heat exchange cooler 41 of gas arranged in connection with the gas treatment reactor. This entity provides an arrangement for generating oxidizable product gas from solid fuel, by means of which arrangement, good quality product gas can he generated in a reliable manner by utilizing thermal cracking and, at the same time, taking care of the melt components generated in the thermal cracking in an operationally reliable manner by solidifying them to a non-sticky form and by treating them in a non-sticky form.

Product gas is thus generated in a gasification reactor 12' and conducted substantially non-cooled to a gas treatment reactor 20 following the gasification reactor 12' in a flow direction of the product gas. A radiation heat exchange cooler 41 for gas is in connection with the gas treatment reactor 20, which, in this embodiment, is further connected, for example, to a convection boiler 40 for the further cooling of the product gas.

The gas treatment reactor 20 is preferably a vertical reactor, in which, gas is arranged to flow substantially from the top downwards. The upper portion thereof is provided with an inlet 26 for introducing product gas to the reactor 20. The gas treatment reactor 20 preferably comprises a supply 22 for introducing oxygenous gas to the reactor 20, preferably, arranged into connection with, the inlet 26. Supply 22 is in connection with a gas source 24, preferably, containing either oxygen or a mixtures of oxygen and steam. Supply 22 for introducing oxygenous gas to the reactor can also comprise separate channels for oxygenous gas and steam, whereby supply 22 is in connection both with a source of oxygenous gas and a source of steam (not shown). In order to efficiently treat the product gas, supply 22 for introducing gas oxygenous gas has preferably been arranged to the centerline of the inlet 26 in such a way that oxygenous gas and steam can be led to the reactor in such a way that the flow thereof is directed substantially in parallel with the flow direction of the product gas.

The oxygen supplied through supply 22 oxidizes a portion of the combustible components of the product gas, and the temperature of the gas rises. Thus, when the apparatus is operated, an oxidizing zone 27 is formed in connection with the inlet 26. The inlet area in the upper portion of the gas treatment reactor 20 is provided with refractory lining 34, such as masonry. The masonry lining has been used for coating substantially all surfaces in the upper portion of the gas treatment reactor 20. The lining continues to a distance from the inlet in such a manner that it extends at least until it covers the oxidation zone of the gas treatment reactor 20.

The refractory lining 34 acts as heat insulation and, thus, the structure allows the gas temperature to increase high enough to bring about thermal cracking. The structure external of the refractory lining 34 may as such be a cooled structure because of the endurance of the structure. A temperature of about 1100° C. to about 1400° C. is preferably maintained in the upper portion of the gas treatment reactor 20. Although, herein, this is referred to as an oxidation zone, it must be understood that the product gas is only partially oxidized at this stage and that, also, the final product gas is still oxidizable gas. At a high temperature, tar compounds of the product gas ate cracked by thermal cracking, whereby the amount of tar compounds in the product gas diminishes, since the tar compounds formed in the product gas decompose to simpler compounds. At the same time, the product gas used for combustion is compensated for by compounds generated by thermal cracking.

The high temperature maintained in the gas treatment reactor 20 softens or even melts the solids, which can also be called fly ash, arriving to the gas treatment reactor 20 through the separator 14. The softened fly ash panicles stick on the surrounding surfaces, from which they can be removed by soot blowing. for this purpose, the arrangement preferably comprises soot blowers. High pressure water injectors have preferably been arranged in connection with the refractory-lined surface of the gas treatment reactor 20, whereby it is possible to remove ash stuck on the refractory-lined surface by high pressure water injection.

The radiation heat exchange cooler 41 begins from beneath the refractory-lined portion, from the close proximity thereof In other words, the walls 21 of the lower portion of the gas treatment reactor 20 act as radiation heat exchangers, which cool the product gas. The radiation heat exchange cooler 41 is formed of walls 21, which define a gas volume in the radiation heat exchange cooler 41, which gas volume is a substantially free space. In other words, no heat exchanger structures affecting the gas flow are arranged in the gas volume. Softened and/or melted fly ash thereby also sticks on the walls of the lower portion of the gas treatment reactor 20. Preferably, soot blowers 44 are in connection with the walls of the lower portion of the gas treatment reactor 20, by means of which it is possible to remove the solidified material that accumulates on the walls. The soot blowers 44 may be, for example, rapping hammer type soot blowers, which can provide impact to a wall of the radiation heat exchanger 41 from outside thereof. The soot blowers 44 are preferably positioned to operate on ail surfaces of the radiation heat exchange cooler 41.

A turn chamber 28 for the gas flow is provided in the lower portion of the gas treatment reactor 20, from which chamber, a gas outlet opening 30 opens to convection boiler 40. Also, the walls of the turn chamber 28 act at the same time as radiation heat exchangers. In the lower portion of the turn chamber 28, a discharger connection 46 for removing solid material separated in a solid form from the product gas. The solid material separated, from the walls of the lower portion of the gas treatment reactor 20 is guided along the walls of the reactor 20 and turn chamber 25 to the discharge connection 46, to be further treated.

Especially, biofuels contain ash, which have alkali components, such as potassium and sodium. The alkali components melt at the high temperature of the thermal cracking. In the presence of chlorine and, other ash components, the sodium and potassium salts form a very strongly corroding mixture in die melt phase, which is very harmful for many lining materials and pressure vessel steels. This can be, according to an embodiment of the invention, considerably decreased by adding an appropriate amount of peat or other fuel containing acid components, such as silicon or sulfur, thereby, the corroding effect of the melt ash generated in the thermal cracking will substantially decrease.

Figure 2:
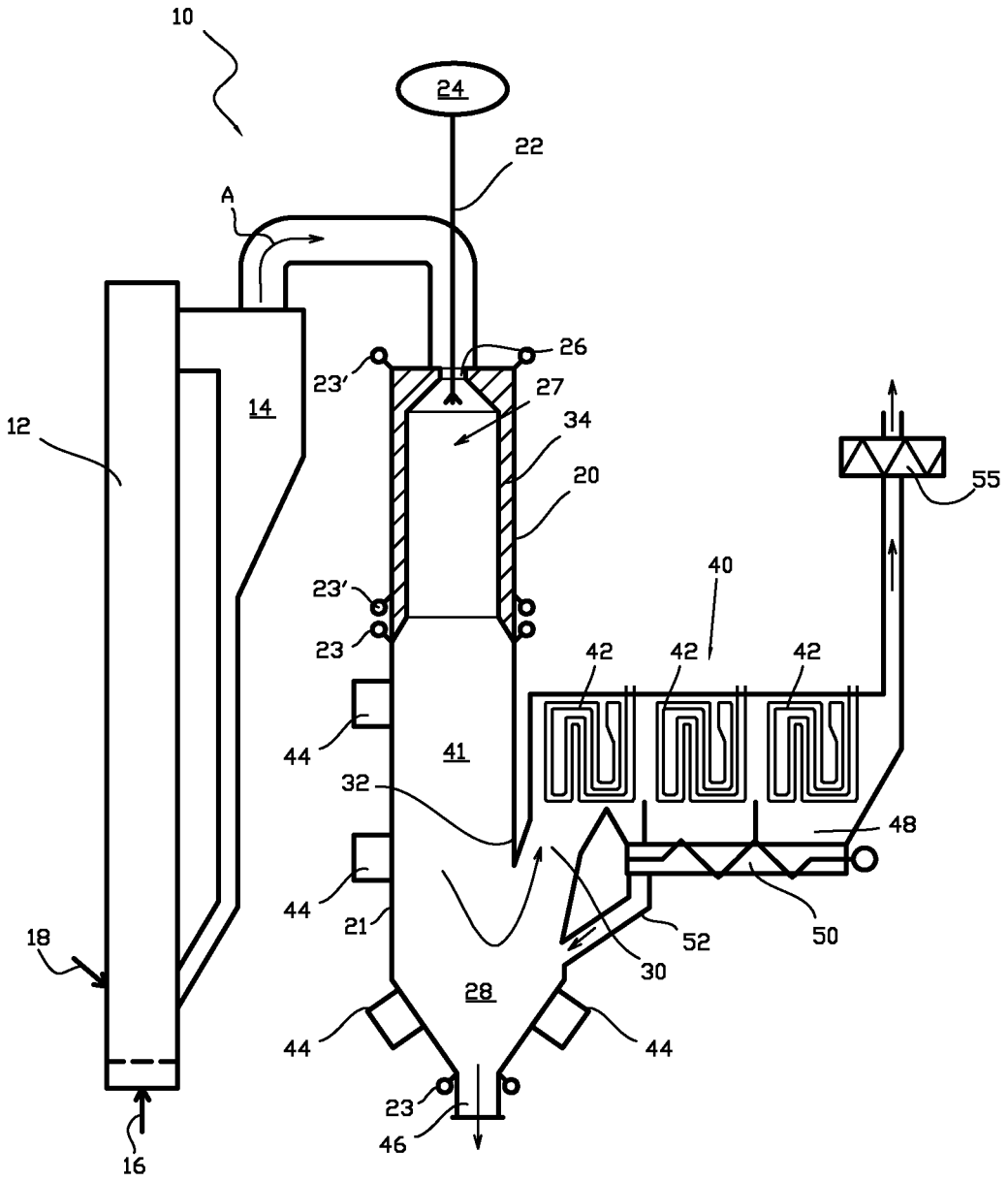
FIG. 2 schematically illustrates another embodiment of an arrangement in accordance with the invention.

FIG. 2 illustrates another embodiment of an arrangement 10 in accordance with the invention for gasifying solid fuel. The embodiment of FIG. 2 comprises a circulating fluidized bed reactor 12, which acts as a gasification reactor, and fuel is gasified in a fast fluidized bed formed from the gasification reactor in such a way that oxidizable product gas is generated. The arrangement also comprises a treatment reactor 20 for gas generated in the fluidized bed reactor 12 and connected in a flow direction of the product gas in flow connection with the circulating fluidized bed reactor 12, and a radiation heat exchange cooler 41 is arranged in connection therewith.

The arrangement is especially advantageous when the fuel that is used is biomass. The structure and basic operation of a circulating fluidized bed reactor 12 is known as such. The circulating fluidized bed reactor 12 comprises, for example, an inlet 16 for fluidizing gas and an inlet 18 for fuel and/or bed material. The circulating fluidized bed reactor 12 also comprises a separation apparatus 14 for separating solid material, such as one or more cyclones, in which solid material, especially, bed material, is separated from the product gas and returned as a so-called external circulation back to the fluidized bed reactor 12. The product gas is conducted from the separation apparatus 14 of the circulating fluidized bed reactor 12 to a gas treatment reactor 20 following it in the gas flow direction, shown with arrow A, substantially non-cooled. A radiation heat exchange cooler 41 for gas is in connection with the gas treatment reactor 20, which is, in this embodiment, further connected to a convection boiler 40, which is a so-called horizontal boiler. All the main heat exchangers 42 in the horizontal boiler are horizontally, subsequently supported. The gas cooler 41 is mainly formed of radiation heat exchanger surfaces 21.

The gas treatment reactor 20 is also, in this case, preferably, a vertical reactor, in which gas is arranged to flow substantially from the top downwards. An inlet 26 is arranged in the upper portion thereof for introducing product gas to the reactor 20. The gas treatment reactor 20 preferably comprises a supply 22 for supplying oxygenous gas to the reactor 20 arranged in connection with the inlet 26. The supply 22 is in connection with a gas source 24, preferably, containing either oxygen or a mixture of oxygen and steam. Supply 22 for supplying oxygenous gas to the reactor 20 can also comprise separate channels for oxygenous gas and steam, whereby supply 22 is in connection both with a source of oxygenous gas and a source of steam (not shown). In order to efficiently treat the product gas, the supply 22 for feeding oxygenous gas is preferably arranged to the centerline of the inlet 26 and in such a manner that oxygenous gas and steam can be supplied to the reactor 20 in such a way that the flow thereof is directed substantially m parallel with the flow direction of the product gas.

The oxygen supplied through the supply 22 oxidizes a portion of the combustible components of the product gas, and the gas temperature rises. Thus, when the apparatus is in operation, an oxidation zone 27 is formed in connection with the inlet 26. The inlet area in the upper portion of the gas treatment reactor 20 is supplied from the inside with a refractory lining 34, such as masonry. The refractory lining 34 is used for substantially all of the surfaces in the upper portion of the gas treatment reactor 20. The refractory lining 34 continues from the inlet to a distance therefrom in such a manner that it extends at least to such a distance that the oxidation zone of the gas treatment reactor 20 Is within the area of the refractory lining 34. The refractory lining 34 acts as heat insulation and the structure thus allows the rise of the gas temperature high enough lo bring about thermal cracking. The structure external of the refractory lining 34 may as such be a cooled structure because of the endurance of the structure. Preferably, a temperature of about 1100° C. to about 1400° C. is maintained in the upper portion of the gas treatment reactor 20. Although herein h is referred to as an oxidation zone, it must be understood that the product gas is only partially oxidized at this stage, and also, the final product gas is still oxidizable gas. At a high temperature, tar compounds of the product gas are decomposed by means of thermal cracking, whereby the amount of tar compounds in the product gas diminishes, because the far compounds formed in the product gas decompose to simpler compounds. At the same time, the product gas consumed to combustion is compensated for by compounds generated by thermal cracking.

When the circulating fluidized bed reactor 12 is operated in the embodiment of FIG. 2, according to an embodiment in such a way that the gasification temperature is decreased in the reactor 20, the amount of solid carbon and/or hydrocarbons entrained from the fluidized bed reactor 12 to the gas treatment reactor 20 through a separator 14 increases. The partial oxidation of the gas treatment reactor 20 thereby changes in such a way that the flame formed therewith is more advantageous as for the radiation heat exchange and, thus, the efficiency of the radiation heat exchange can be increased in the gas treatment reactor 20.

The high temperature maintained in the gas treatment reactor 20 softens or even melts solid material arriving to the gas treatment reactor 20 through the separator 14, which may also be called fly ash. Softened fly ash particles stick, on the surrounding surfaces, from which they can be removed by soot blowing.

Therefore, the arrangement also preferably comprises soot blowers. High pressure water injectors are preferably arranged in connection with the refractory lined surfaces of the gas treatment reactor 20, whereby ash stuck on the refractory lined surfaces can be successfully removed, for example, by means of high pressure water injection.

The walls of the lower portion of the gas treatment reactor 20 below the refractory lined portion act as radiation heat exchangers, cooling down product gas. The radiation heat exchange cooler is formed of walls defining a gas volume in the radiation heat exchange cooler, the gas volume being a substantially free space. In other words, no heat exchanger structures affecting the gas flow are arranged in the gas volume. When the gas is cooled down, softened and/or melted fly ash also sticks to a certain extent to the walls of the lower portion of the gas treatment reactor 20 and solidifies on the surfaces thereof for this purpose, soot blowers 44 are preferably provided in connection with the wails of the lower portion of the gas treatment reactor 20, by means of which, material solidified and accumulated on the walls can be removed. Soot blowers 44 are rapping hammer type soot blowers, by means of which, impacts can be generated on the wall of the radiation heat: exchanger from outside thereof.

As can be seen in the drawings, the radiation heat exchanger, in other words, cooled wall, comprises heat exchange channels, such as tubes. The collecting headers of the tubes in the cooled wall are referred to with reference number 23 in the figures. The heat exchange channel of the radiation heat exchange cooler 41 extends in the drawings only below the refractory lined portion or to the lower end thereof. Thereby, the structure of the upper portion can be joined with the radiation heat exchange cooler 41 in such a manner that the use of soot blowers 44 arranged in connection with the radiation heat exchange cooler 41 does not cause any significant transmission of soot blowing impacts, which are adverse to the endurance of the refractory lining, to the refractory lining. It has also been shown in FIG. 2 how the refractory lining of the upper portion can be of a separately cooled structure, the collecting headers of cooling tubes of which, are shown with reference number 23'.

A turn chamber 28 for the gas flow is arranged in the lower portion of the gas treatment reactor 20, from which a gas discharge opening 30 opens to a convection boiler 40, substantially upwards. The walls of the turn chamber 28 also operate at the same time as radiation heat exchangers. Tire lower portion of the turn chamber 28 is provided with a discharge connection 46 for the discharge of solid material separated from the product gas. The solid material separated from the walls of the lower portion of the gas treatment reactor 20 is conducted along the wails of the reactor 20 and the turn chamber 28 to the discharge connection 46 to be further treated.

In the embodiment of FIG. 2, the turn chamber 28 is formed in the gas treatment reactor 20 in such a manner that it comprises, with the convection boiler 40, a common wall 32, the gas being arranged to flow beneath the common wall 32. Thus, the direction of the product gas flow is changed in the lower portion of the gas treatment reactor 20 by ninety to one hundred eighty degrees, whereafter, the product gas flow is conducted to the convection boiler 40. The direction of the product gas flow is preferably changed by one hundred thirty-five to one hundred eighty degrees.

Gas is conducted from the turn chamber 28 to the convection boiler 40. At least one heat exchanger, preferably, two heat exchangers 42, which are horizontally, subsequently supported, are arranged to the gas space thereof. Solid material from the product gas also sticks on the surfaces of the heat exchangers 42 of the convection boiler and needs to be removed from the surfaces. When the heat exchangers 42 are arranged horizontally, subsequently, in other words, not one on top of the other, it is possible to prevent the solid material, dislodged from the heat exchanger 42, first in the gas flow direction, from being drilled to the surfaces of the following heat exchanger 42.

Collecting spaces 48 for solid material are arranged beneath the heat exchangers 42. The first heat exchanger is preferably, however, partially above the discharge opening 30 of the turn chamber 28. More solid material accumulates on the surface of the first heat exchanger than on the other heat exchangers 42 of the convection boiler 40, and it is thus advantageous that the solid material removed from the first heat exchanger may fall, due to gravity, directly to the lower portion of the turn chamber 28, to be removed. A conveyor 50, such as a screw conveyor, is in connection with a collecting space beneath the other heat exchangers 42 subsequent to the first heat exchanger, by means of which, solid material separated from these heat exchangers 42 is also conducted to the lower portion of the turn chamber 28 through a channel 52 connecting them.

The cooled gases are conducted from the convection boiler 40 through a possible filtering apparatus 55 to be further used.

By mixing peat with biofuel it is possible to have an effect on the behavior of the ash at the same time. In such a way that the stickiness of the ash to the refractory lining of the gas treatment reactor diminishes, or the ash can be easily removed from the refractory lined surfaces.

According to an embodiment of the invention, the fuel to be gasified is bio fuel, whereby a predetermined amount of peat is dosed to the fuel and/or bed material. The method of gasifying solid fuel thereby comprises a step of determining the amount and/or quality of melted and/or sticky material generated in the gas treatment reactor, and adjusting the amount of peat in the fuel in such a manner that the amount and/or quality of melted and/or sticky material generated in the gas treatment reactor is within predetermined limits. Thus, the fouling of the convection boiler can also be diminished, and the soot blowing of ash from the heat surfaces made easier by adding peat to the biofuels. The bed material or the bed material mixture used in a fluidized bed gasifier may also be used for influencing the stickiness or easiness of soot blowing of the ash.

It must be noted that the description above discloses only some of the most preferred embodiments of the invention. Thus, it is obvious that the invention is not limited to the disclosed embodiments, but it can be applied in many ways. The arrangement also can be realized In such a way that a so-called slow fluidized bed is used as the gasification reactor. Features described in connection with different embodiments can also be used in connection with other embodiments within the basic concepts of the invention and/or disclosed features can be combined with different entities, if so desired, and they are technically feasible.

The invention claimed is:

1. An arrangement for gasifying solid fuel, the arrangement comprising:

a gasification reactor for producing oxidizable product gas from solid fuel;

a gas treatment reactor, arranged in a flow direction of the product gas, in gas flow connection with the gasification reactor, the gas treatment reactor being a vertical reactor and comprising a supply for supplying oxygenous gas to the gas treatment reactor for partial oxidization and thermal cracking of the product gas, wherein (i) an upper portion of the gas treatment reactor is provided with an inlet for supplying the product gas to the gas treatment reactor, and a lower portion thereof is provided with a radiation heat exchange cooler enabling to cool the product gas by radiation heat exchange in such a way that melted components in the product gas solidify to solidified components, and (ii) wherein the radiation heat exchange cooler includes walls having heat exchange surfaces and defining a gas space in the radiation heat exchange cooler, the gas space being a substantially free space; and a discharge connection arranged in a lower portion of the radiation heat exchange cooler for removing the solidified components from the radiation heat exchange cooler.

2. An arrangement in accordance with claim 1, wherein the upper portion of the gas treatment reactor comprises a refractory coating.

3. An arrangement in accordance with claim 1, wherein the lower portion of the radiation heat exchange cooler is provided with a turn chamber for the gas flow, a lower portion of he turn chamber being provided with the discharge connection, and the turn chamber being provided with a gas discharge opening in such a manner that the gas flow direction substantially changes in the turn chamber.

4. An arrangement in accordance with claim 3, wherein the gas discharge opening is connected with a convection boiler, which comprises at least one heat exchanger.

5. An arrangement in accordance with claim 4, wherein the at least one heat exchanger is arranged directly above a bottom portion of the convection boiler and a bottom portion of the convection boiler is provided with a conveyor for conveying solid material.

6. An arrangement in accordance with claim 5, wherein the conveyor is arranged to convey solid material from the bottom portion of the convection boiler to the lower portion of the turn chamber, arranged in the lower portion of the radiation heat exchange cooler.

7. An arrangement in accordance with claim 1, wherein the gasification reactor is a circulating fluidized bed reactor comprising a solids separator, a gas discharge connection of which is in gas flow connection with the gas treatment reactor.

8. A method of gasifying solid fuel in a gasification reactor, the method comprising:

producing oxidizable product gas from gasification of solid fuel in a gasification reactor;

leading the product gas from the gasification reactor to an upper portion of a vertical gas treatment reactor, which is supplied with oxygenous gas, so that the product gas is partially oxidized and its temperature is increased, to thereby achieve thermal cracking of the components of the product gas, wherein solid components of the product gas are at least one of melted and softened to become sticky, forming melt components;

directing the product gas from the gas treatment reactor to a radiation heat exchange cooler formed of walls of a lower portion of the gas treatment reactor having heat exchange surfaces and defining a gas space in the radiation heat exchange cooler, the gas space being a substantially free space, arranged in the lower portion of the gas treatment reactor, in which radiation heat exchange cooler the temperature of the product gas is diminished by radiation heat exchange in such a way that melt components in the product gas are solidified; and discharging the solidified components from the radiation heat exchange cooler in a solid form through a discharge connection arranged in a lower portion of the radiation heat exchange cooler.

9. A method in accordance with claim 8, further comprising guiding the product gas to flow in the gas treatment reactor substantially vertically from up downwards, and that in the lower portion of the radiation heat exchange cooler, the direction of the product gas flow is changed, whereafter the product gas flow is redirected to a convection boiler.

10. A method in accordance with claim 9, further comprising conducting the oxidizable product gas from the radiation heat exchange cooler to the convection boiler, to at least one heat exchanger, of which the at least one of the melted and sticky softened, non-decomposed solid components of the product gas are further brought to stick.

11. A method in accordance with claim 10, further comprising removing solid components stuck on the at least one heat exchanger from the at least one heat exchanger and guiding the removed solid components to a bottom portion underneath the heat exchanger to be removed from the convection boiler.

12. A method in accordance with claim 8, wherein the oxidizable product gas is produced from solid fuel combusted in a fluidized bed.

13. A method according to claim 12, further comprising at least partially controlling the material composition of the fluidized bed based on at least one of the melting and softening behavior of the gas components taking place in the gas treatment reactor.

* * * * *